United States Patent [19]

Muns

[11] 4,275,574

[45] Jun. 30, 1981

[54] STOP MECHANISM FOR RACHEL OR KETTEN TYPE KNITTING MACHINE

[76] Inventor: Joaquin M. Muns, Burgos, 3, Rubi, (Barcelona), Spain

[21] Appl. No.: 5,035

[22] Filed: Jan. 19, 1979

[30] Foreign Application Priority Data

Jun. 19, 1978 [ES] Spain ..... 236.964

[51] Int. Cl.[3] ..... D04B 35/14

[52] U.S. Cl. ..... 66/163; 139/354

[58] Field of Search ..... 28/187; 66/163, 164; 139/353, 354

[56] References Cited

U.S. PATENT DOCUMENTS

| | | | |
|---|---|---|---|
| 1,942,524 | 1/1934 | Welch et al. | 66/163 |
| 2,436,438 | 2/1948 | Kyner | 66/163 |
| 2,734,956 | 2/1956 | Berker | 66/163 |
| 2,777,026 | 1/1957 | Vossen | 139/354 |
| 2,955,343 | 10/1960 | Bassindale | 28/187 |
| 3,869,770 | 3/1975 | McCullough | 28/187 |
| 4,100,425 | 7/1978 | Ohsawa | 28/187 |

FOREIGN PATENT DOCUMENTS

| | | | |
|---|---|---|---|
| 1079637 | 8/1967 | United Kingdom | 66/163 |

*Primary Examiner*—Henry Jaudon

*Attorney, Agent, or Firm*—Haseltine and Lake

[57] ABSTRACT

A stop mechanism for knitting machines of the Rachel type comprising a reed with an upper flange fitted with a strengthening section projecting from and along a whole edge for guiding a thread. A contact which is fixed for threads not forming a nap, and is movable and cylindrical for threads produces a nap. The reed has small plates and blade components between these plates. The blade components are bent to form a groove for guiding the thread. Each blade component has two circular holes and one elongated hole and the built-in tendency for toppling over onto this contact. The blade components and small plates are connected by two spindles. The contact may have a chordal flat for increasing its contact area and is attached to an electrical conductor at one of its extreme ends and can be moved along a semicircular path by a crank. A metal spindle attached to an electrical wire passes through the circular hole innermost on the blade component.

5 Claims, 11 Drawing Figures

FIG. 8A
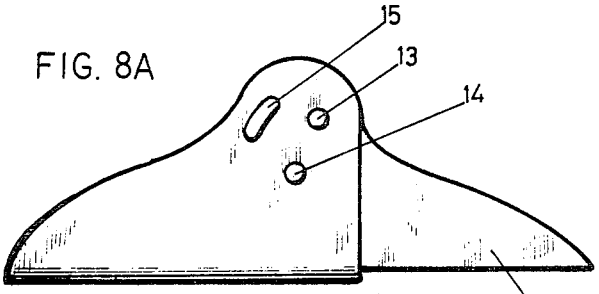
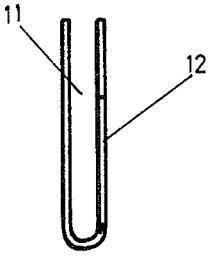
FIG. 8B
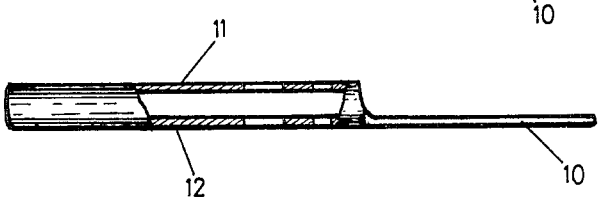
FIG. 8C
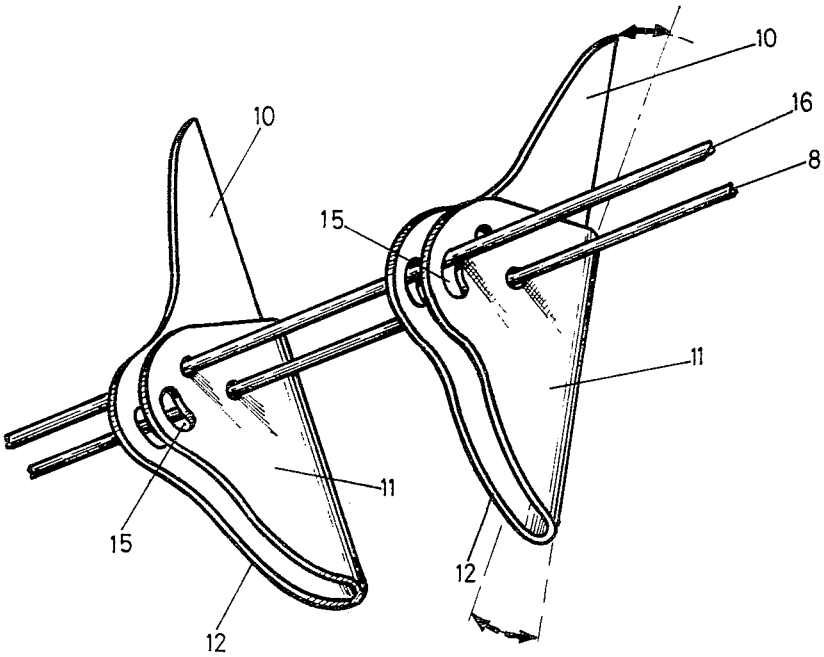
FIG. 9

STOP MECHANISM FOR RACHEL OR KETTEN TYPE KNITTING MACHINE

BACKGROUND OF THE INVENTION

The present invention relates to a stop mechanism for a knitting machine of the Rachel or Ketten type, the introduction of which on this type of machine results in a change in operation, allowing the detection of any of the threads breaking at the moment at which it occurs, causing the machine to stop automatically, in such a manner that one operator may with ease control several machines.

The advent of the device known as a stop mechanism, on looms generally resulted in a major revolution in the work as it allowed the control of several machines by one person without that person having to be at hand continuously at each machine. When there is a breakage in the thread, the machine stops completely so that the fault can be corrected and then the operation started up again without producing faults in the material being produced. The type of stop mechanism usually consists of blades which are fitted so as to ride on the thread, arranged in such a manner that at the moment of rupture of the thread two electrical contacts close so as to complete a circuit which generates a signal, which in turn stops the machine. This type of stop mechanism has to be placed manually one by one between each thread making up the cloth, this being an operation which is relatively time consuming but which is absolutely essential to the automation of these machines.

The machine of the Rachel ot Ketten type have in the past presented major difficulties in connection with the fitting of the stop mechanism, the only system being employed being the photoelectric cell. Apart from not giving a hundred percent detection of breakages, the photoelectric cell does not prevent the occurrence of faults in the material prior to the fault being detected which means that once the material has been made it must be submitted to a group of inspectors whose job it is to examine the faults made in the material and mend them, thus holding up the shipping of the material from the factory which slows down the rotation of the stock.

SUMMARY OF THE INVENTION

The stop mechanism which is described below results in a radical alteration in what is known in the art with reference to the Rachel machines. By its use it is possible not only to detect with absolute certainty all instances of breakage in the thread; moreover, this detection takes place before the material has become produced hence at the end of the process there is no wastage, reducing considerably the work of the inspectors and also the time that the finished goods need to stay in the factory prior to shipment to the points of sale.

The stop mechanism which will be described below consists essentially of a blade component having a channel which provides a guide for the thread and which is so designed that the center of gravity is continually above its center of gyration thus giving it a tendency to rest on an electrical contact, a tendence which is opposed solely by the force of the thread which is passing such that upon elimination of this force due to a breakage of the thread the stop mechanism will make contact with the electrical contact, closing the circuit and generating a signal which will cause the machine to stop.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 8A, 8B and 8C are elevational, side and plan views, respectively, of a stop mechanism according to the invention; and FIG. 9 is a perspective view of the stop mechanism spindle-insertion system in the stop and working positions.

DESCRIPTION OF THE PREFERRED EMBODIMENTS

Figure 1:
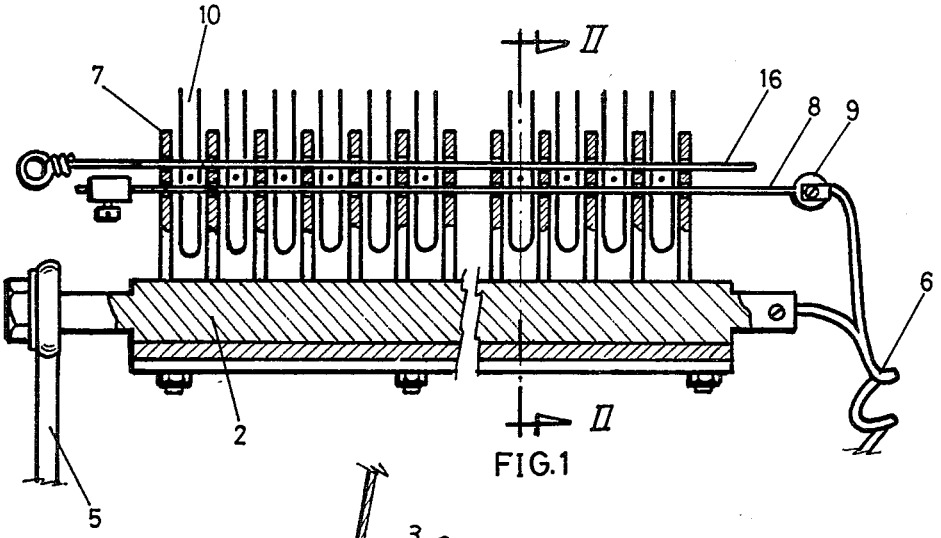
FIG. 1 is a top plan view, partly in horizontal section, of a reed equipped with a stop mechanism according to the invention.
Figure 2:
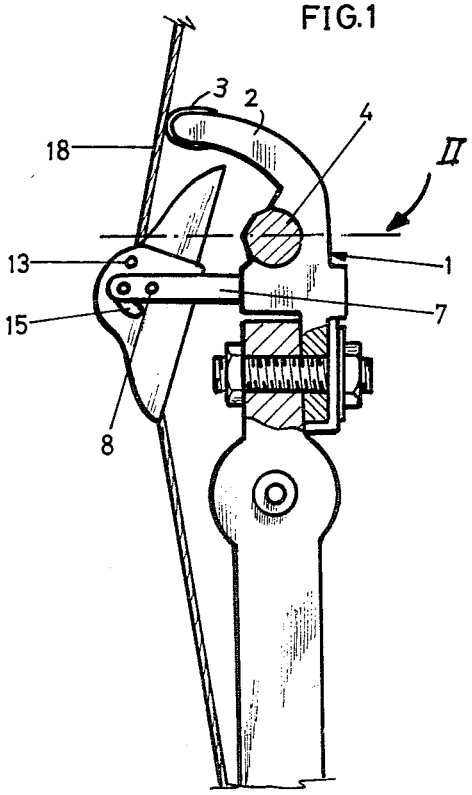
FIGS. 2, 3 and 4 are side views of FIG. 1, seen from the left side thereof, showing the stop mechanism with taut thread, broken thread and no thread, respectively.

As may be deduced from the aforementioned drawings, a reed 1 is fitted with a flange 2 which has along its entire edge a section 3 preferably of stainless steel, covering its whole length while below the flange is a channel which holds the electrical contact 4. This contact may be selectively fixed or mobile and in the latter case will be attached to crank 5 from which emerges an electric wire 6 making up one of the elements of the electric circuit.

The component which guides the thread 18 to be supervised is situated between the small plates 7. These make up the teeth of the reed and attached to them is a spindle 8 which at one of its extreme ends is joined to an electric terminal 9. This component 10, of which is mounted between each two adjacent plates 7, is formed of a blade bent into two parts 11 and 12 of which part 11 is of the greater length and at the one end comes to a point. The part 12 is of lesser length, both being perforated by two circular holes 13 and 14 and a third elongated hole 15 having, moreover, a further spindle 16 which connects all the components 10 to the respectively adjacent blades 7.

The provision of the section 3 on flange 2 is of utmost importance insofar as its task is that of a protector which prevents damage to the flange 2 by the friction of the running thread which, being taut, rubs against it. The thread is continuously held between parts 11 and 12 in the groove which is provided in the respective component 10. As has been indicated previously, this groove has as its fundamental feature the fact that it is designed in such a way that it tends to rest on the contact 4. In addition to the hole 14, through which is inserted the spindle 8, each component has a hole 13 (see FIG. 8A) by means of which the components 10 are strung together. These holes are untapped and the components 10 are held only by the presence of threads 18 so that they do not touch electrical contact 4. Meanwhile the elongated hole 15 is provided to take the spindle 16, thus preventing the thread 18 in the respective component 10 from escaping while at the same time allowing a certain or predetermined amount of movement of the component sufficient to permit it to contact the electrical contact 4 in the event of a thread breakage.

Figure 5:
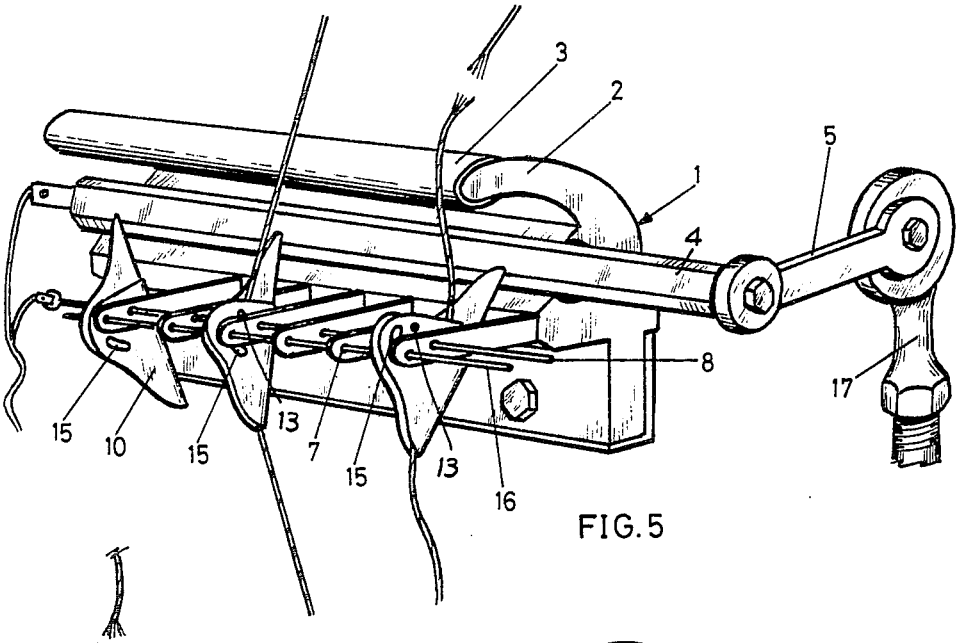
FIG. 5 is a perspective view of an arrangement incorporating three of the inventive stop mechanisms, each shown in a different operating position.
Figure 3:
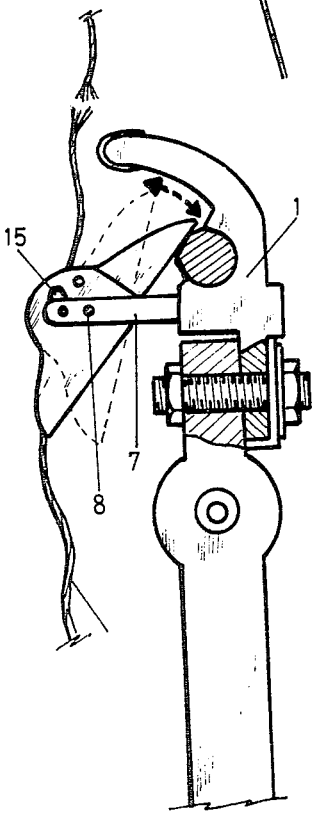
Figure 4:
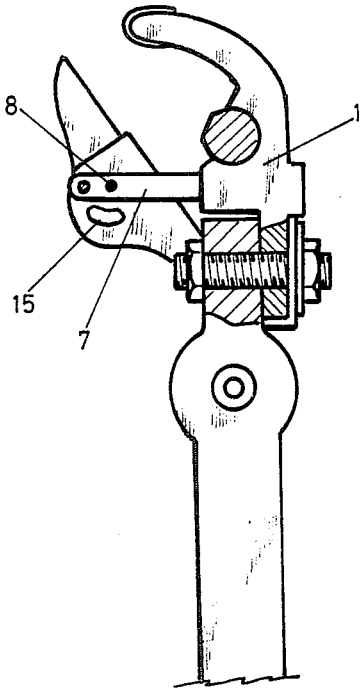
Figure 6:
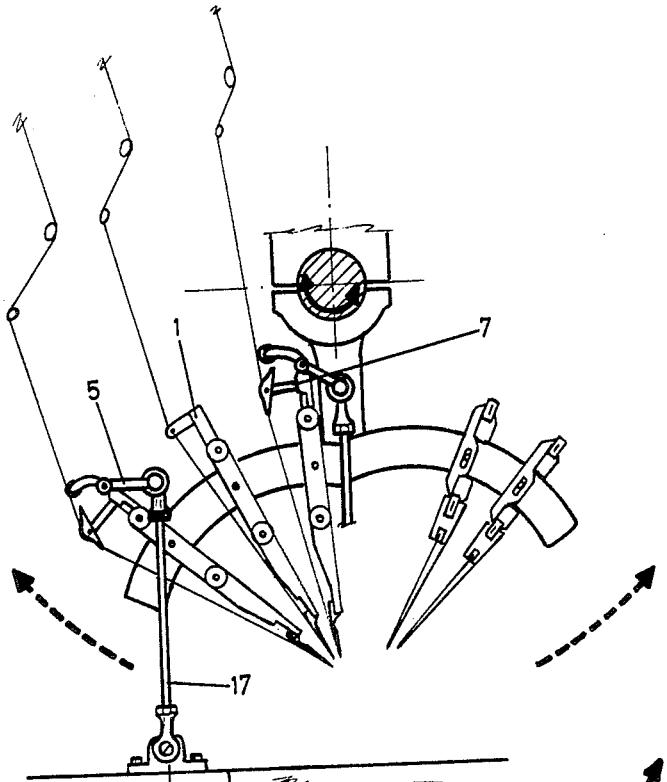
FIG. 6 shows the assembly of the contact-activating connecting rod on the bedframe.
Figure 7:
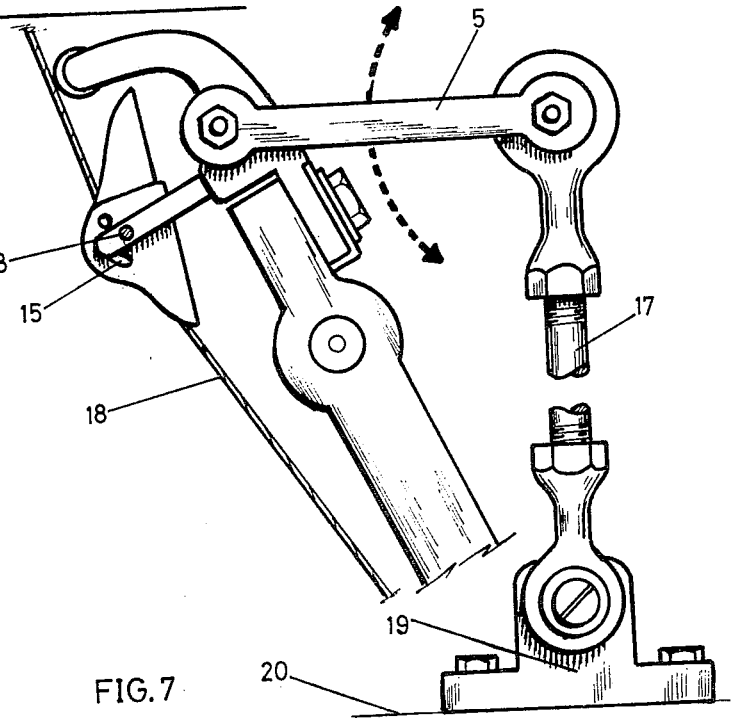
FIG. 7 shows a detail of the assembly in FIG. 6.

In cases where the thread is suffciently strong so that it does not lose the nap which covers it, thus not making a perfect contact, the contact 4 can be fixed. In cases where the thread readily produces this type of nap it is advisable to attach movable contacts which have a cylindrical shape on which has been cut a chordal plane. This plane provides a flat zone of contact, thus considerably increasing the possibility of mutual contact between the latter and component 10. The nap is removed by means of a rotational movement which can be applied to electrical contact 4 by operation of the crank 5 that may be connected via a connecting rod 17 having two bell joints (FIGS. 5 and 7), the bottom one of which is connected to an element 19 secured to the machine bedframe 20, to any of the machine shafts which can impart to it a semicircular movement.

When a machine equipped according to the invention is readied for operation, the threads 18 are led over the section 3 and placed into the channels of respective elements 10. Thereafter, spindle 16 is inserted through the holes 15 of those of the elements 10 which have received one of the threads 18. In those of the elements 10 where no thread 18 has been placed, the spindle 16 is inserted through hole 13 (rather than hole 15) to prevent these elements from automatically (i.e. in the absence of threads 18) making contact with element 4 and thus stopping the machine. The elements 10 of course turn freely (so long as no thread 18 is present or as they are not prevented by spindle 16 extending through holes 13) about spindle 8; when one of the inserted threads 18 breaks, the elongation of the hole 15 is sufficient to permit the element 10 in question to turn about the spindle 8 until it engages contact 4 and stops the machine.

Without further analysis, the foregoing will so fully reveal the gist of the present invention that others can, by applying current knowledge, readily adapt it for various applications without omitting features that, from the standpoint of prior art, fairly constitutes essential characteristics of the generic or specific aspects of this invention, and therefore, such adaptations should and are intended to be comprehended within the meaning and range of equivalence of the following claims.

What is claimed is:

1. A stop mechanism for knitting machines of the Rachel type comprising: a reed with an upper flange fitted with a strengthening section projecting from and along a whole edge for guiding a thread; contact means fixed for thread not forming a nap and being movable and cylindrical for thread producing a nap; said reed having small plates; blade components between said small plates; said blade components being bent to form a groove for guiding the thread; said blade components having each two circular holes and one elongated hole, and having a tendency for toppling over onto said contact means; said blade components and said small plates being connected by two spindles, said stop mechanism being mounted above lower reeds of said knitting machine.

2. A stop mechanism as defined in claim 1 wherein said contact means is cylindrical and has a chordal flat to increase area of contact; an electrical conductor attached at one of its extreme ends to said contact means; a crank connected to any rotating shaft of said loom for moving said contact means along a semicircular path by said crank.

3. A stop mechanism as defined in claim 1 wherein a metal spindle attached to an electric wire passes through one of said circular holes innermost on said blade component.

4. A stop mechanism as defined in claim 1 wherein one of said spindles passes through an outer one of said circular holes when said stop mechanism need not be tranversed by a thread due to design of cloth being woven for preventing said blade component from toppling over onto said contact means.

5. A stop mechanism as defined in claim 1 wherein one of said spindles passes through said elongated hole when the stop mechanism carries a thread for allowing sufficient movement in case of thread breakage for said blade component to drop on said contact means for closing a circuit and providing a signal for stopping said loom.

* * * * *